US006033193A

United States Patent [19]

Pieters et al.

[11] Patent Number: 6,033,193

[45] Date of Patent: Mar. 7, 2000

[54] SINGLE SEAL GEAR PUMP

[75] Inventors: Ferdinandus A. Pieters, Camas, Wash.; Stephen Michael Burns, Portland, Oreg.; Roy D. Hollie, Vancouver; James Roberts, Ridgefield, both of Wash.

[73] Assignee: Micropump Corporation, Vancouver, Wash.

[21] Appl. No.: 09/085,122

[22] Filed: May 27, 1998

[51] Int. Cl.[7] ..... F04B 17/00; F04C 2/18

[52] U.S. Cl. ..... 417/420; 417/410.4

[58] Field of Search ..... 417/420, 410.4

[56] References Cited

U.S. PATENT DOCUMENTS

| | | | |
|---|---|---|---|
| 4,065,235 | 12/1977 | Furlong et al. | 417/420 |
| 4,111,614 | 9/1978 | Martin et al. | 417/420 |
| 4,127,356 | 11/1978 | Martin et al. | 417/420 |
| 4,165,206 | 8/1979 | Martin et al. | 417/420 |
| 4,846,641 | 7/1989 | Pieters et al. | 417/420 |
| 5,466,131 | 11/1995 | Altham et al. | 417/420 |

*Primary Examiner*—Andrew M. Dolinar
*Attorney, Agent, or Firm*—Hill & Simpson

[57] ABSTRACT

A gear pump is disclosed. The gear pump has a pump body with an inlet, a discharge and an interior side to the body. The gear pump also has a cavity plate having a gear cavity formed therein facing and abutting the interior side of the pump body. A drive gear and a driven gear are located within the gear cavity and engage one another. Each gear is rotatably supported on a shaft between the pump body and the cavity plate. A drive magnet assembly is connected to the drive gear shaft. A magnet cup has an interior chamber and a sealing surface which abuts against the interior side of the pump body providing the only required seal of the gear pump. The magnet cup is received over and encapsulates the magnet assembly, the cavity plate and the gears within the interior chamber and compresses the gear cavity against the interior surface of the body without requiring additional sealant to seal the gear cavity and magnet cup interior chamber.

16 Claims, 2 Drawing Sheets

SINGLE SEAL GEAR PUMP

BACKGROUND OF THE INVENTION

This invention relates generally to gear pumps, and more particularly to a gear pump requiring only one seal and having a reduced number of parts.

A typical gear pump includes at least two and sometimes at least three gears including a drive gear and a driven gear housed within a pumping chamber. If magnetically coupled to a motor, such a pump also typically includes a magnet assembly within a separate chamber for driving the gears. A typical gear pump also includes a number of seals and fasteners and other components in order to fully assemble the pump. Each seal and each separate component of the pump adds to the fabrication and assembly complexity and cost of a pump assembly. Additionally, each seal is a potential leak path of pump fluid. Further, each separate component of the pump assembly creates a potential failure point for such a pump.

SUMMARY OF THE INVENTION

The present invention is directed to a gear pump assembly having a minimum number of components and requires only one seal. A second seal for a pump bypass valve is utilized if such an optional bypass is included. The pump has excellent sealing characteristics and high leak-free reliability at a reduced manufacturing, assembly and component cost. The pump of the invention accomplishes these goals by housing all of the pump components within a single contained volume requiring only one fluid seal.

In one embodiment, a gear pump constructed according to the invention has a pump body with an inlet, a discharge and an interior side on the body. A cavity plate with a gear cavity formed within the plate faces and abuts the interior side of the body. A drive gear and a driven gear are disposed within the gear cavity and engage one another. Each of the gears is rotatably supported on its own shaft between the body and the cavity plate. A drive magnet assembly is connected to the drive gear shaft for rotating the drive gear which in turn rotates the driven gear. A magnet cup has an interior chamber and a sealing surface abutting against the interior side of the body. The magnet cup is received over and encapsulates the magnet assembly, the cavity plate and the gears within its interior chamber. A housing is received over the magnet cup and compresses the sealing surface against the interior side of the body.

In one embodiment, the gear pump has a groove formed in the pump body and a seal received in the groove. The seal is sandwiched between the pump body and the sealing surface of the magnet cup. In one embodiment, the seal is an elastomer O-ring.

In one embodiment, the gear pump has a compression surface extending from the cavity plate opposite the pump side. The compression surface has a free end abutting against a portion of the magnet cup.

In one embodiment, the gear pump has an interior shoulder formed within the magnet cup in the interior chamber. The compression surface of the cavity plate abuts against the interior shoulder of the magnet cup.

In one embodiment, at least one resilient member extends from the free end of the compression surface. The resilient member abuts against the interior shoulder of the magnet cup.

In one embodiment, the compression surface is in the form of at least three pillars extending from the cavity plate opposite the pump side. Each of the pillars has a free end with a resilient member extending therefrom which abuts against the interior shoulder of the magnet cup.

In one embodiment, the resilient member extending from each pillar is a compression spring received within a bore in the pillar and a spring extending from the free end of the pillar supported by the compression spring. Each pin abuts against the interior shoulder of the magnet cup.

In one embodiment, the magnet cup of the gear pump has a resilient spring shoulder formed thereon. The free end of the compression surface abuts against the resilient spring shoulder of the magnet cup.

In one embodiment, the gear pump includes a first housing section of the housing which is received over the magnet cup assembly. The first housing section has a compression flange which sandwiches a portion of the magnet cup between the compression flange of the first housing section and the free end of the compression surface.

In one embodiment, the gear pump has an annular flange section extending around the pump body. The first housing section of the housing is secured to the annular flange section.

In one embodiment, the gear pump has an additional second housing section which is secured to the first housing section and is adapted to connect the gear pump to a motor for driving the magnet assembly.

In one embodiment, the gear pump has at least two dowel pins which extend between the pump and the cavity plate for properly aligning the two components relative to one another.

In one embodiment, a bypass valve communicates with the pump discharge of the gear cavity for permitting fluid to be recirculated back to the inlet side of the gear cavity.

These and other objects, features and advantages of the present invention will become apparent upon review of the detailed description, appended claims and accompanying drawing figures.

DETAILED DESCRIPTION OF THE PREFERRED EMBODIMENTS

Figure 1:
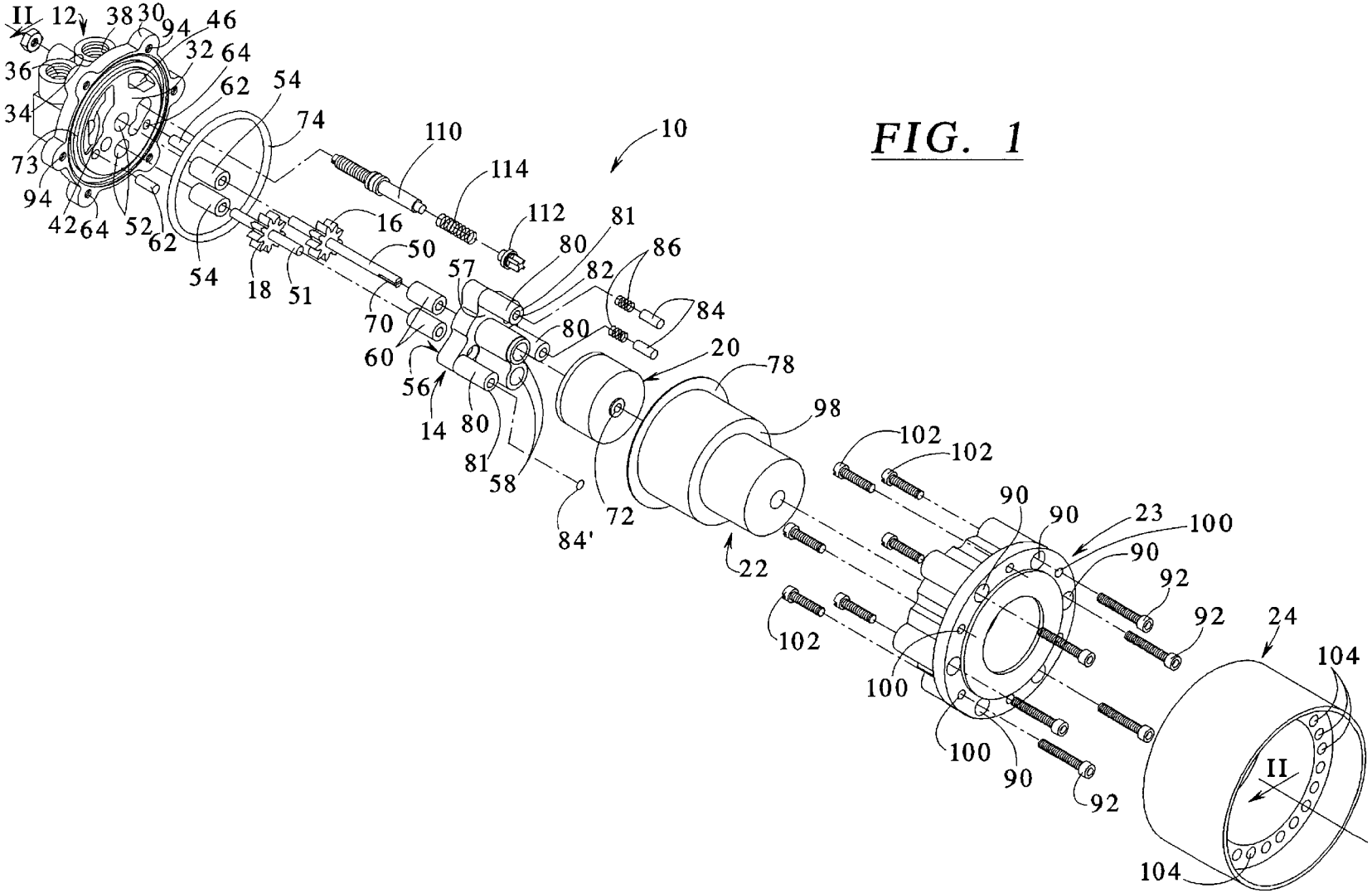
FIG. 1 illustrates an exploded perspective view of a gear pump assembly constructed in accordance with one embodiment of the present invention.
Figure 2:
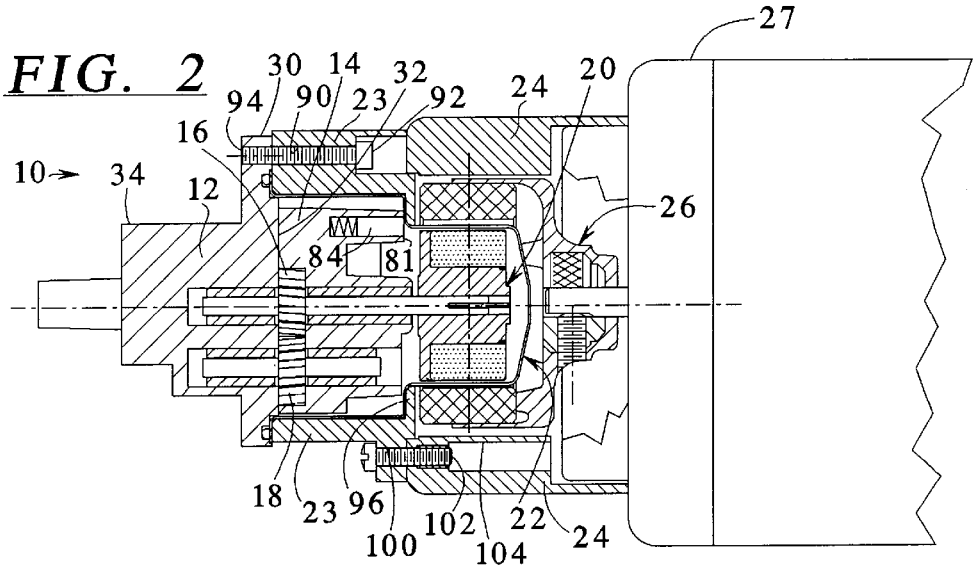
FIG. 2 illustrates a cross section of the gear pump assembly of FIG. 1 taken along line II—II.
Figure 4:
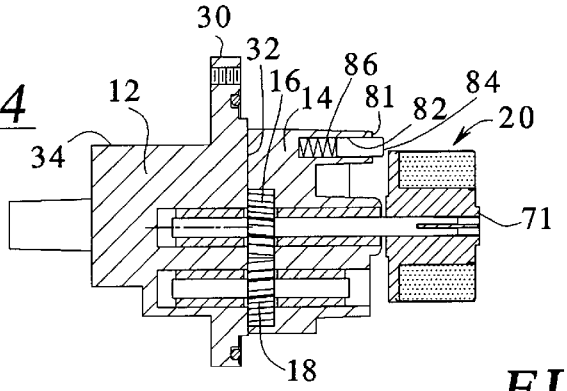
FIG. 4 illustrates a cross section of only the pump body, cavity plate and magnet assembly of FIG. 2.

Referring now to the drawings, FIG. 1 illustrates a gear pump assembly 10 in exploded view and constructed in accordance with one embodiment of the present invention. FIG. 2 illustrates a cross section of the gear pump 10 as assembled. The pump assembly 10 houses all of the pump components within a single vessel or chamber and requires only a single fluid seal for the major pump components. The construction of the pump assembly 10 produces a more reliable, substantially leak-free pump design which has a reduced number of parts and a reduced number of seals than other known pump designs.

Referring now to FIGS. 1 and 2, the gear pump 10 includes generally a pump body 12, a cavity plate 14, and a pair of gears including a drive gear 16 and a driven gear 18 sandwiched between the cavity plate and the body. A pump drive magnet assembly 20 is received on the opposite side of the cavity plate 14 which is energized to drive the drive gear 16. A magnet cup 22 is received over the magnet assembly 20 and the cavity plate 14 in a manner which is further described below. The pump assembly 10 also has a pump drive housing including first and second housing sections 23 and 24 to mount the pump to a motor and protect the basic pump components. A motor (not shown) and motor housing 27 may be connected to the housing section 24 to energize the magnet assembly 20 through the drive housing sections 23 and 24.

As best illustrated in FIGS. 1 and 2, the pump body 12 includes a flange section 30 and an interior side 32 of the body which faces the gears 16 and 18 and the cavity plate 14. The pump body also includes a port section 34 extending from the side of the body 12 opposite the interior side 32. The port section 34 includes an inlet port 38 and an outlet port 36. The inlet port 38 communicates with a fluid inlet passage (not shown) which passes through the port section 34 and flange section 30 of the pump body 12 and communicates with a fluid inlet opening 105 on the interior side 32 of the pump body. Similarly the output port 36 communicates with a fluid discharge passage (not shown) which passes through the pump body 12 and communicates with a fluid discharge opening 42 on the interior side 32 of the pump body.

Fluid moved by the pump assembly 10 enters the inlet port 38, flows through the inlet passage and exits via the inlet opening 105 to the interior side 32 of the pump body. The fluid then enters the discharge opening 42, flows through the discharge passage and exits the pump assembly 10 through the outlet port 36. The inlet port 38 and outlet port 36 may be adapted to connect by any known means to fluid lines for a particular pump application and may be oriented in any manner relative to the pump body and to one another.

The drive gear 16 and driven gear 18 are each carried on an elongate rotary shaft 50, 51, respectively, suspended between the pump body 12 and the cavity plate 14. The interior side 32 of the pump body 12 includes a pair of bores 52, each receiving therein a suitable low friction and high wear resistance bushing 54. One bushing 54 is received over one end of each of the gear shafts 50 and 51, for rotationally supporting each of the gear shafts in the pump body 12.

The cavity plate 14 includes a pump side 56 and a magnet side 57. The pump side 56 faces the interior side 32 of the flange section 30 and the magnet side faces the magnet assembly 20. The pump side 56 includes a similar pair of bores 58 receiving therein a similar pair of bushings 60 for rotationally supporting the opposite ends of the shafts 50 and 51. The pump side 56 also includes a recessed gear cavity 61 into which the gears 16 and 18 are seated. The gear cavity 61 is in fluid communication with the fluid inlet opening 105 and discharge opening 42.

Also as illustrated in FIG. 1, a pair of alignment or dowel pins 62 are received in additional blind bores 64 formed in the interior side 32 of the pump body 12. The dowel pins 62 are received in the blind bores 64 extending outward therefrom. The protruding portion of the dowel pins is further received in similar alignment openings (not shown) formed in the cavity plate 14 for properly aligning the cavity plate relative to the pump body 12 and for maintaining the alignment therebetween. Proper alignment is essential so that unnecessary binding forces are not applied to either end of the gear shafts 50 after the pump is assembled, which would otherwise cause reduced pump efficiency and excessive gear wear.

One end of the drive gear shaft 50 of the drive gear assembly 16 includes an interlocking mechanism such as a splined end, square end, slot or other suitable interlock. This end of the shaft 50 is received in a central bore 72 of the magnet assembly 20. The interlock mechanism rotationally fixes the shaft 50 to the magnet assembly 20 so that the gear shaft rotates relative to movement of the magnet assembly. In the present embodiment, a slot 70 interlocks with a tab or tongue 71 within the bore 72 of the magnet assembly 20. The magnet assembly 20 is magnetically coupled to a driving magnet 26 (see FIG. 2) which is attached to a motor shaft or any type of rotating magnetic field and driven by via energy provided by the motor (not shown) through the magnet cup 22.

Figure 3:
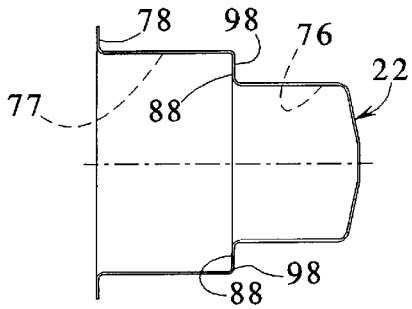
FIG. 3 illustrates a side perspective view of one embodiment of a magnet cup for the pump assembly of FIG. 1.

The interior side 32 of the pump body 12 includes a groove 73 and an O-ring 74 received therein and extending about the perimeter of the flange section 30. When the pump is assembled as shown in FIG. 2, the magnet cup 22 is received over the components of the gear pump 10. The magnet cup 22 shown in FIGS. 1–3 has an interior chamber 75 with a recessed first interior section 76 which receives therein the magnet assembly 20. The magnet cup 22 has a larger diameter recessed second interior section 77 which receives therein the cavity plate 14. The magnet cup 22 also includes an outwardly extending radial flange defining a sealing surface 78 at the opening of the cup. When the magnet cup 22 is assembled to the pump body 12, the sealing surface 78 overlies the O-ring 74 providing a sealed interior for the gear pump 10. The single O-ring 74 is the only seal required for all the components of the entire gear pump 10 except for a separate, optional bypass valve assembly which is described below.

As illustrated in FIG. 1, the cavity plate 14 includes three pillars 80 extending from the magnet side 57 axially relative to the orientation of the gear shafts 50 and 51 from the cavity plate toward the magnet cups 22. Each pillar 80 has a distal end defining a compression surface 81 and includes an axial blind bore 82 formed therein. In the present embodiment, an elongate pin 84 is received within each bore 82. The pins 84 are supported by a compression spring 86 received within each blind bore 82. Other resilient means such as elastomeric balls 84' may be used and received within the blind bores 82 without departing from the scope of the present invention. The pins 84 and springs 86 abut against a portion of the magnet cup 22 on an interior shoulder 88 defined at the juncture between the recesses 76 and 77. The resiliency of the pins 84 and springs 86 produce a tight, vibration-free and consistent fit of the magnet cup 22 over the cavity plate 14, provide compression of the cavity plate against the interior side 32 of the pump body 12, and yet accommodate tolerance variation between the pump interior surface 32 and the height of the pillars 80.

As illustrated in FIG. 2, the first section 23 of the drive housing is received over the magnet cup 22 and secured to the pump body 12 at the flange section 30. As illustrated in FIG. 1, the first housing section 23 includes a plurality of fastener openings 90 which are recessed into the outer perimeter of the first section. A plurality of corresponding fasteners 92 are received within the openings 90 to secure the first section 23 to the pump body via a plurality of fastener openings 94 in the flange section 30. This is best illustrated in FIG. 2. The, first housing section 23 also includes an in-turned lip or flange 96 which rests against the exterior surface 98 of the interior shoulder 88. The O-ring 74 provides an adequate seal between the magnet cup 22 and the pump body 12.

The second section 24 of the housing is then received over the first section 23 as best illustrated in FIG. 2. A plurality of fastener openings 100 are provided around the perimeter of the first section 23 of the housing alternatingly between the fastener openings 90. A plurality of fastener openings 104 are also provided in the second section 24 of the housing which correspond to the openings 100. A plurality of fasteners 102 are utilized to secure the second section 24 to the first section 23 of the housing via the openings 100 and 104.

Also as illustrated in FIG. 1, the gear pump 10 may include a bypass valve 110 of a conventional construction having a poppet valve body 112 and a compression spring 114 for biasing the poppet valve body 112 relative to the valve 110 as desired. The bypass valve assembly 110 provides for fluid to recirculate from the gear cavity 61 of the gear pump 10 back to the inlet passage if for some reason the fluid pressure within the gear pump exceeds a desired value. The bypass valve 110 requires an additional separate seal to prevent fluid from exiting the pump around the valve assembly.

The sealing surface 78 of the magnet cup 22 compresses the O-ring 74 providing a sealed chamber defined by the contour of the interior chamber 75 of the enclosed magnet cup. All of the pump fluid is free to flow within the sealed chamber defined by the magnet cup 22 but may not exit the pump except though the bypass valve 110 or the discharge outlet 42. The single seal 74 is the only fluid seal of the entire pump assembly 10 therefore providing a highly reliable gear pump construction which is substantially leak free.

Figure 5:
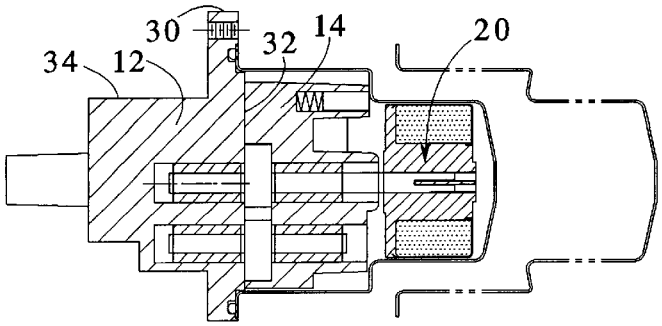
FIG. 5 illustrates a cross section of the pump body, cavity plate and magnet assembly of FIG. 4 including an alternate embodiment of a magnet housing shown assembled over the magnet assembly and cavity plate and also shown unassembled in phantom view.
Figure 6:
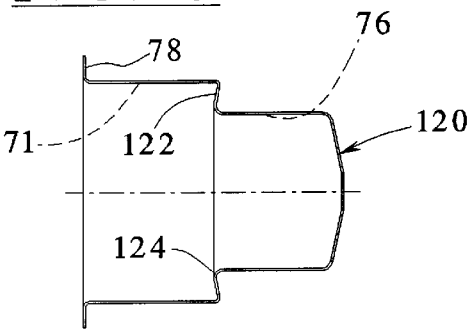
FIG. 6 illustrates a side perspective view of the magnet cup of FIG. 5.

An alternative embodiment of a magnet cup 120 is illustrated in FIG. 6 and in phantom view in FIG. 5. The magnet cup 120 is essentially the same as the magnet cup 22 except that a spring flange 122 replaces the shoulder 88 of the magnet cup 22 and extends between the interior sections 76 and 77. The spring flange 122 is formed at an angle relative to a plane defined by the flange or sealing surface 78. The inner edge 124 of the spring flange 122 on the interior side of the magnet cup 120 rests against the compression surface 81 or pin 84, or both, of each of the pillars 80 when installed as is illustrated in FIG. 5.

When the first section 23 of the housing is assembled to the pump body 12 over the magnet cup 120, the spring flange 122 is intended to flex about the edge 124 in order to provide resiliency of the magnet cup relative to the cavity plate 14. This spring flange 122 may be used in place of the pins 84 and springs 86 or in conjunction therewith without departing from the scope of the present invention. In each embodiment of the spring cup 22 or 120, pillars 80, and the pins 84 and springs 86, the resiliency of the various components is intended to pre-load the cavity plate 14 against the interior surface 32 of the pump body 12. This essentially ensures that pump fluid passes from the inlet 105 to the gear cavity 61 and the magnet cup chamber and to the outlet 42 of the pump body. As will be evident to those skilled in the art, the compression surface 81 may take on other configurations and constructions, such as an annular raised surface without departing from the scope of the invention.

It should be understood that various changes and modifications to the presently preferred embodiments described herein will be apparent to those skilled in the art. Such changes and modifications may be made without departing from the scope and spirit of the present invention and without diminishing its attendant advantages. It is therefore intended that such changes and modifications be covered by the appended claims.

What is claimed is:

1. A gear pump comprising:

a pump body having an inlet, a discharge and an interior side;

a cavity plate having a pump side and a gear cavity formed therein facing the interior side of the body and communicating with the inlet and the discharge;

a drive gear and at least one driven gear engaging one another and located within the gear cavity, each gear rotatably supported on a shaft between the body and cavity plate;

a drive magnet assembly connected to the drive gear shaft;

a magnet cup having an interior chamber and a sealing surface against the interior side of the body, the magnet cup received over and encapsulating the magnet assembly and the cavity plate and the gears within the interior chamber; and a housing received over the magnet cup and compressing the sealing surface against the interior side of the body.

2. The gear pump according to claim 1, further comprising:

a groove formed in the pump body; and a seal received in the groove sandwiched between the pump body and the sealing surface of the magnet cup.

3. The gear pump according to claim 1, further comprising:

a groove formed in the pump body; and an elastomer O-ring seal received in the groove sandwiched between the pump body and the sealing surface of the magnet cup.

4. The gear pump according to claim 1, further comprising:

a plurality of pillars extending from the cavity plate opposite the pump side and each having a free end abutting against a portion of the magnet cup.

5. The gear pump according to claim 1, further comprising:

an interior shoulder formed within the magnet cup; and a plurality of pillars extending from the cavity plate opposite the pump side and each having a free end abutting against the interior shoulder of the magnet cup.

6. The gear pump according to claim 1, further comprising:

an interior shoulder formed within the magnet cup;

a plurality of pillars extending from the cavity plate opposite the pump side and each having a free end; and a resilient member extending from the free end of each pillar wherein each resilient member abuts against the interior shoulder of the magnet cup.

7. The gear pump according to claim 1, further comprising:

an interior shoulder formed within the magnet cup;

a plurality of pillars extending from the cavity plate opposite the pump side and each having a free end; and a resilient elastomer ball extending from the free end of each pillar wherein each elastomer ball abuts against the interior shoulder of the magnet cup.

8. The gear pump according to claim 1, further comprising:

an interior shoulder formed within the magnet cup;

a plurality of pillars extending from the cavity plate opposite the pump side and each having a free end and a bore formed into the free end;

a compression spring received within the bore of each pillar; and a pin extending from the free end of each pillar supported by the compression spring wherein each pin abuts against the interior shoulder of the magnet cup.

9. The gear pump according to claim 1, further comprising:

a resilient spring shoulder formed on the magnet cup; and a plurality of pillars extending from the cavity plate opposite the pump side and each having a free end abutting against the resilient spring shoulder of the magnet cup.

10. The gear pump according to claim 1, further comprising:

a plurality of pillars extending from the cavity plate opposite the pump side and each having a free end;

a first housing section of the housing received over the magnet cup assembly; and a compression flange on the first housing section sandwiching a portion of the magnet cup between the compression flange and the free end of each of the pillars.

11. The gear pump according to claim 1, further comprising:

an annular flange section extending around the pump body; and a first housing section of the housing received over the magnet cup and secured to the annular flange section of the pump body.

12. The gear pump according to claim 1, further comprising:

an annular flange section extending around the pump body;

a first housing section of the housing received over the magnet cup and secured to the annular flange section of the pump body; and a second housing section of the housing secured to the first housing section and adapted to connect to a motor for driving the magnet assembly.

13. The gear pump according to claim 1, further comprising:

a plurality of dowel pins extending between the pump body and the cavity plate for properly aligning the two relative to one another.

14. The gear pump according to claim 1, further comprising:

a bypass valve communicating with the gear cavity for recirculating fluid from the gear cavity back to the inlet.

15. A gear pump comprising:

a pump body having an inlet, a discharge and an interior side;

a cavity plate having a pump side, a magnet side, a gear cavity formed in the pump side communicating with the inlet and the discharge, and a compression surface formed on the magnet side;

a drive gear and a driven gear engaging one another and located within the gear cavity, each gear rotatably supported on a shaft between the body and cavity plate;

a drive magnet assembly connected to the drive gear shaft;

a magnet cup having an interior chamber, a sealing surface against the interior side of the body, and compression shoulder formed thereon, the magnet cup received over and encapsulating the magnet assembly and the cavity plate within the interior chamber;

a plurality of resilient members extending from the compression surface of the cavity plate; and a housing received over the magnet cup and compressing the sealing surface against the interior side of the body and compressing the compression shoulder against the plurality of resilient members of the compression surface.

16. A gear pump comprising:

a pump body having an inlet, a discharge and an interior side;

a cavity plate having a pump side and a gear cavity formed therein facing the interior side of the body and communicating with the inlet and the discharge, and a magnet side having a compression surface thereon;

a drive gear and a driven gear engaging one another and located within the gear cavity, each gear rotatably supported on a shaft between the body and cavity plate;

a drive magnet assembly connected to the drive gear shaft;

a magnet cup having an interior chamber, a sealing surface against the interior side of the body, and a spring flange, the magnet cup received over and encapsulating the magnet assembly and the cavity plate within the interior chamber; and a housing received over the magnet cup and compressing the sealing surface against the interior side of the body and compressing the spring flange against the compression surface.

* * * * *